US008083507B2

(12) United States Patent
Park et al.

(10) Patent No.: US 8,083,507 B2
(45) Date of Patent: Dec. 27, 2011

(54) VACUUM PUMP HAVING ROTATION BODY CLEANING UNIT WITH SPRAYING HOLES ON AN OUTPUT SURFACE OF THE CLEANING BODY SURROUNDING A SHAFT

(75) Inventors: Tea-Jin Park, Gyeonggi-do (KR); Seung-Ki Chae, Seoul (KR); Kwang-Myung Lee, Gyeonggi-do (KR); Sang-Gon Lee, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 791 days.

(21) Appl. No.: 12/050,063

(22) Filed: Mar. 17, 2008

(65) Prior Publication Data

US 2008/0226485 A1 Sep. 18, 2008

(30) Foreign Application Priority Data

Mar. 16, 2007 (KR) ..... 10-2007-0026034

(51) Int. Cl.
*F01C 1/30* (2006.01)
*F03C 2/00* (2006.01)

(52) U.S. Cl. ..... 418/9; 418/5; 418/7; 418/206.1; 418/206.8

(58) Field of Classification Search ..... 418/5–9, 418/15, 206.1, 206.8
See application file for complete search history.

(56) References Cited

U.S. PATENT DOCUMENTS

| | | | | |
|---|---|---|---|---|
| 5,173,041 | A * | 12/1992 | Niimura et al. | 418/9 |
| 5,356,275 | A * | 10/1994 | Brenner et al. | 418/9 |
| 6,471,497 | B2 * | 10/2002 | Suzuki et al. | 418/9 |
| 7,214,041 | B2 * | 5/2007 | Birch et al. | 418/9 |
| 7,748,970 | B2 * | 7/2010 | Park | 418/9 |
| 2008/0118383 | A1 | 5/2008 | Park | |
| 2008/0226485 | A1 | 9/2008 | Park et al. | |
| 2010/0202912 | A1 * | 8/2010 | Park | 418/181 |

FOREIGN PATENT DOCUMENTS

| | | | |
|---|---|---|---|
| JP | 09-027458 | | 1/1997 |
| JP | 2001-25 | | 7/2001 |
| JP | 2003-297762 | | 10/2003 |
| JP | 2005-171766 | | 6/2005 |
| JP | 2006525467 | | 11/2006 |
| KR | 1020050013016 | A * | 7/2003 |
| KR | 1020050013016 | A | 2/2005 |
| KR | 10-2006-0009907 | | 2/2006 |
| KR | 10-2006-0075558 | | 7/2006 |
| KR | 10-2006-0084280 | | 7/2006 |

OTHER PUBLICATIONS

English language abstract of Japanese Publication No. 2001-25.
English language abstract of Japanese Publication No. 2005-171766.
English language abstract of Korean Publication No. 10-2006-0009907.

* cited by examiner

*Primary Examiner* — Theresa Trieu
(74) *Attorney, Agent, or Firm* — Volentine & Whitt, PLLC

(57) ABSTRACT

Provided is a vacuum pump having a rotation body cleaning unit. The vacuum pump includes a case provided with rotation guide holes at opposite end parts. The case includes a rotation body placed inside the case and including a rotation shaft having opposite ends rotatably supported by the rotation guide holes and a number of lobes provided in the rotation shaft at predetermined intervals. Further, a cleaning part is supported by the case and placed in a space between the lobes and cleans the rotation body.

15 Claims, 10 Drawing Sheets

VACUUM PUMP HAVING ROTATION BODY CLEANING UNIT WITH SPRAYING HOLES ON AN OUTPUT SURFACE OF THE CLEANING BODY SURROUNDING A SHAFT

CROSS-REFERENCE TO RELATED APPLICATION

This application claims the benefit of Korean Patent Application No. 2007-0026034, filed Mar. 16, 2007, the contents of which are hereby incorporated herein by reference in their entirety.

BACKGROUND OF THE INVENTION

1. Field of the Invention

This disclosure relates to a vacuum pump, and more particularly, to a rotation body cleaning unit and a vacuum pump having the same.

2. Description of the Related Art

A process chamber for manufacturing a semiconductor device or a flat panel display is used together with various chemicals, such as a process gas. Byproducts and surplus gas in a process chamber are transferred to a gas scrubber through an exhaust unit such as a vacuum pump. The gas scrubber is employed to exhaust the byproducts and the surplus gas after washing/separating them out.

The vacuum pump is provided with a stator and a rotor. An inlet and an outlet are arranged in the stator. The rotor is placed in a pump chamber inside the stator. The vacuum pump may be a roots type, a screw type, a claw type, etc. according to the shape of the rotor.

FIG. 1 is a partial perspective view of a conventional vacuum pump.

Referring to FIG. 1, the conventional vacuum pump includes a rotation shaft 11, a pair of lobes 12, and a first diaphragm 15. A second diaphragm (not shown) may be arranged to face the first diaphragm 15. A cylinder wall (not shown) may be arranged to surround a pump chamber 17 between the first diaphragm 15 and the second diaphragm. The cylinder wall is provided with an inlet and an outlet. The cylinder wall, the first diaphragm 15 and the second diaphragm constitute a stator.

The rotation shaft 11 passes through the first diaphragm 15 and the second diaphragm. The pair of lobes 12 is attached to the rotation shaft 11 and opposite to each other. The pair of lobes 12 and the rotation shaft 11 constitutes a rotor 13. That is, the rotor 13 is placed in the pump chamber 17. In the pump chamber 17, two rotors 13 are situated to be engaged with each other.

By rotating the rotors 13, a gas is drawn from the inlet into the pump chamber 17, and the drawn gas is exhausted through the outlet. In other words, the inlet is connected to the process chamber, and the outlet is connected to the gas scrubber. Byproducts are drawn from the process chamber to the pump chamber 17 through the inlet provided in the cylinder wall, and then exhausted from the pump chamber 17 toward the gas scrubber through the outlet.

Here, the byproducts are solidified as a byproduct lump 19 while passing through the pump chamber 17. Some byproduct lumps 19 may be adhered to the inside of the pump chamber 17.

When the byproduct lumps 19 are adhered to the lobes 12, the first diaphragm 15 or the second diaphragm, they interfere with the rotation of the rotors 13. As a result, the byproduct lumps 19 cause the pumps to be overhauled more frequently and to malfunction.

To solve the foregoing problems, a method of heating the stator has recently been proposed. However, this method not only requires the stator to be made of a material having high heat transfer efficiency, but also needs additional devices and energy to heat the stator.

Embodiments of the invention address these and other limitations in the prior art.

SUMMARY OF THE INVENTION

An embodiment of the invention provides a rotation body cleaning unit and a vacuum pump having the same, in which byproducts produced while manufacturing a semiconductor are prevented from adhering to a rotation body, and the byproducts adhered to the rotation body are easily cleaned.

Another embodiment of the invention provides a rotation body cleaning unit and a vacuum pump having the same, in which a rotation shaft and lobes provided on the rotation shaft are sprayed with different amounts of cleaning material, so that it is possible to selectively control cleaning efficiency with regard to the rotation shaft and the lobes.

In one aspect, the invention is directed to a rotation body cleaning unit.

The rotation body cleaning unit may include: a rotation body provided with a rotation shaft having lobes; and a cleaning part arranged in the vicinity of the lobes and cleaning the rotation body.

The cleaning part may include: a cleaning body having a chamber defined therein; spraying holes for communicating the chamber with the outside and formed on an outer surface of the cleaning body to be oriented toward the rotation body; a supply channel formed in the cleaning body and communicating the chamber with the outside; and a supplier in communication with the supply channel and supplying a cleaning material into the chamber.

The cleaning body may be arranged to surround the rotation shaft.

The chamber may have inclined surfaces symmetrical with respect to a normal line of the rotation shaft.

The spraying holes may include: first spraying holes facing the lobe; and second spraying holes facing the rotation shaft, where the first spraying holes are arranged radially with respect to the rotation shaft and varied in size gradually from the rotation shaft.

The spraying holes may be formed in a direction angled to a rotation direction and its counter direction of the rotation body.

The supply channel may be formed in the cleaning body at a number of positions, and guide the cleaning material to the chamber.

The spraying holes may have different inner diameters.

The rotation body may be rotated by a motor connected to the rotation shaft, the cleaning part may include a controller electrically connected to both the supplier and the motor, and the controller may control the supplier on the basis of the rotation speed of the rotation body rotated by the motor and control the amount of the cleaning material supplied to the chamber.

In another aspect, the invention is directed to a vacuum pump including: a case with rotation guide holes at opposite end parts; a rotation body placed inside the case and including a rotation shaft having opposite ends rotatably supported by the rotation guide holes and a number of lobes in the rotation shaft at predetermined intervals; and a cleaning part supported by the case, placed in a space between the lobes, and cleaning the rotation body.

The rotation body may form a pair, and the lobes of the respective rotation bodies are in contact with each other and interlock with rotation of the rotation shaft, to which external power is applied.

The cleaning part may include: a cleaning body having a chamber defined therein; spraying holes for communicating the chamber with the outside and formed on an outer surface of the cleaning body to be oriented toward the rotation body; a supply channel formed in the cleaning body and communicating the chamber with the outside; and a supplier in communication with the supply channel and supplying a cleaning material into the chamber, wherein the cleaning body is arranged to surround the rotation shaft.

The chamber may have inclined surfaces symmetrical with respect to a normal line of the rotation shaft.

The spraying holes may include: first spraying holes facing the lobe; and second spraying holes facing the rotation shaft, where the first spraying holes are arranged radially with respect to the rotation shaft and varied in size gradually from the rotation shaft.

The spraying holes may be formed in a direction angled to a rotation direction and its counter direction of the rotation body.

The supply channel may be formed in the cleaning body at a number of positions, and guides the cleaning material to the chamber.

The spraying holes may have different inner diameters.

The rotation body may be rotated by a motor connected to the rotation shaft, the cleaning part may include a controller electrically connected to both the supplier and the motor, and the controller may control the supplier on the basis of the rotation speed of the rotation body rotated by the motor and controls the amount of the cleaning material supplied to the chamber.

The case may include an inlet and an outlet which communicate with the inside thereof.

BRIEF DESCRIPTION OF THE DRAWINGS

The foregoing and other features and advantages of the invention will be apparent from the more particular descriptions of preferred embodiments of the invention, as illustrated in the accompanying drawings. The drawings are not necessarily to scale, emphasis instead being placed upon illustrating the principles of the invention.

DETAILED DESCRIPTION OF THE INVENTION

Figure 1:
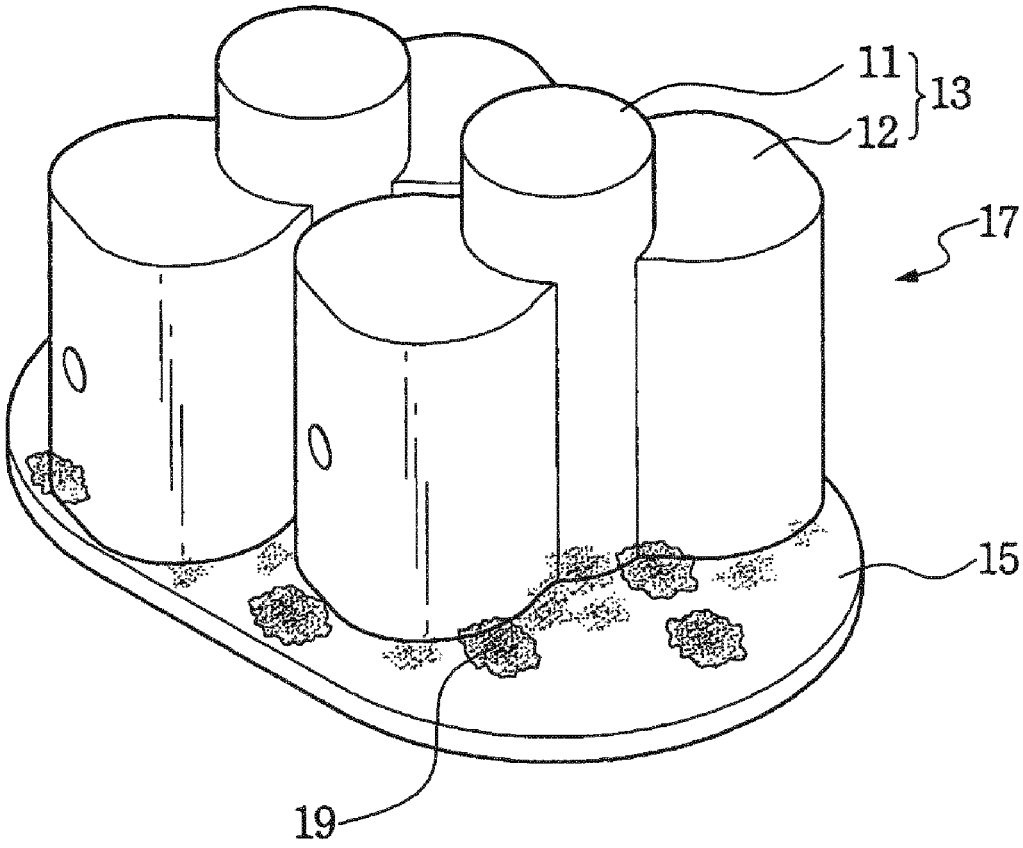
FIG. 1 (CONVENTIONAL ART)
FIG. 1 is a perspective view of a conventional vacuum pump.

Embodiments of the invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout the specification.

Figure 2:
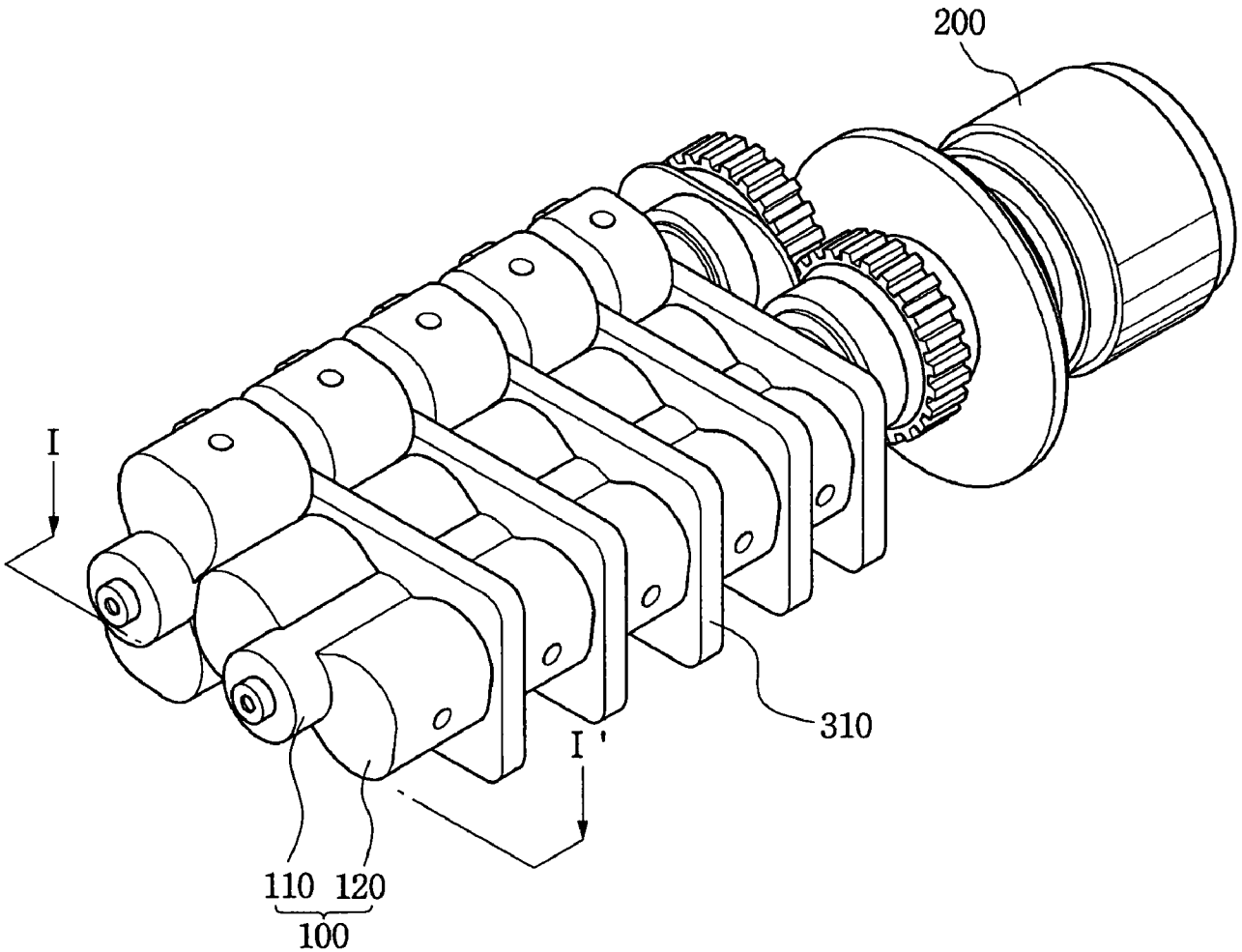
FIG. 2 is a perspective view of a vacuum pump having a rotation body cleaning unit according to exemplary embodiments of the invention.
Figure 3:
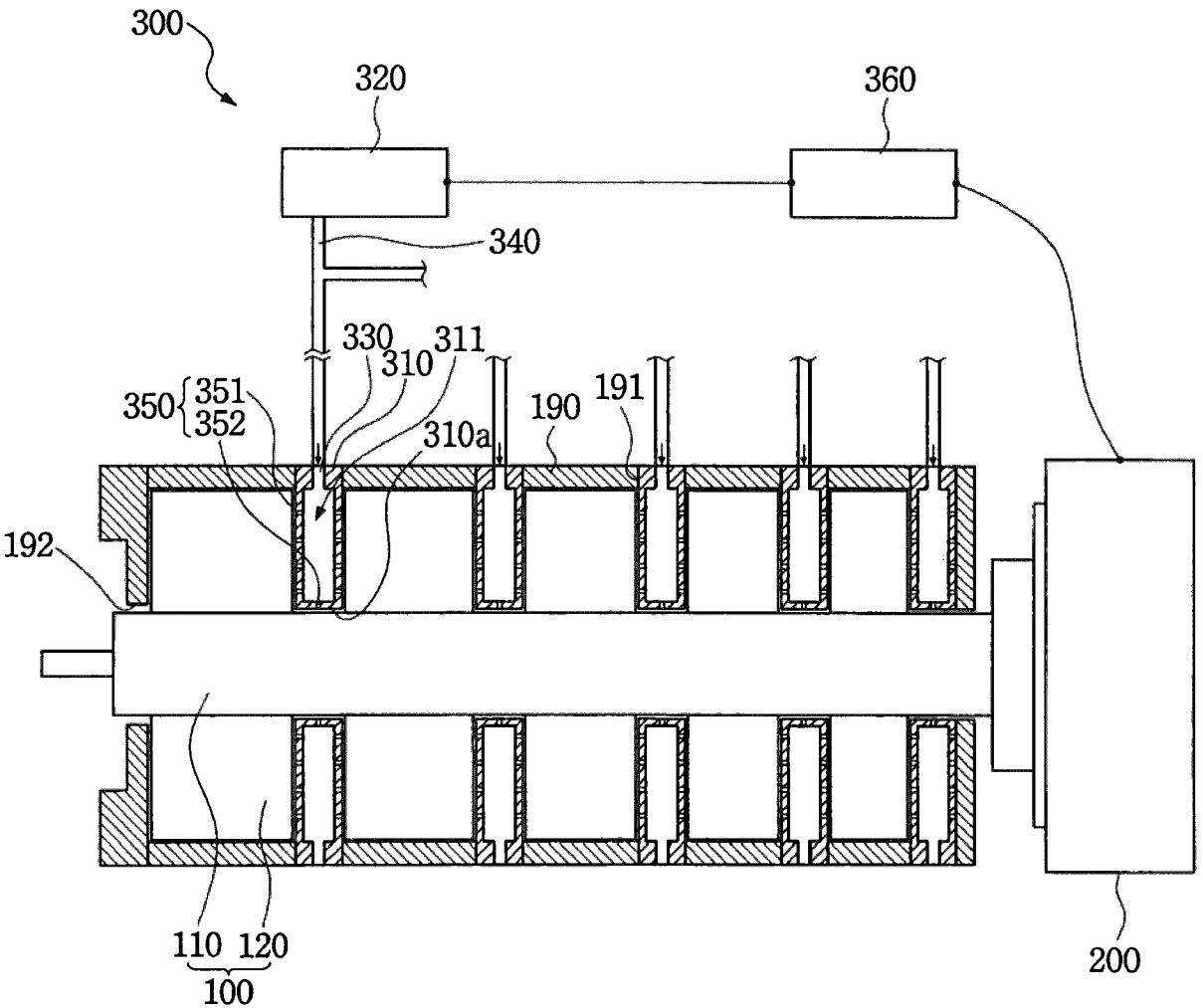
FIG. 3 is a cross-sectional view taken along line I-I' in FIG. 2.
Figure 4:
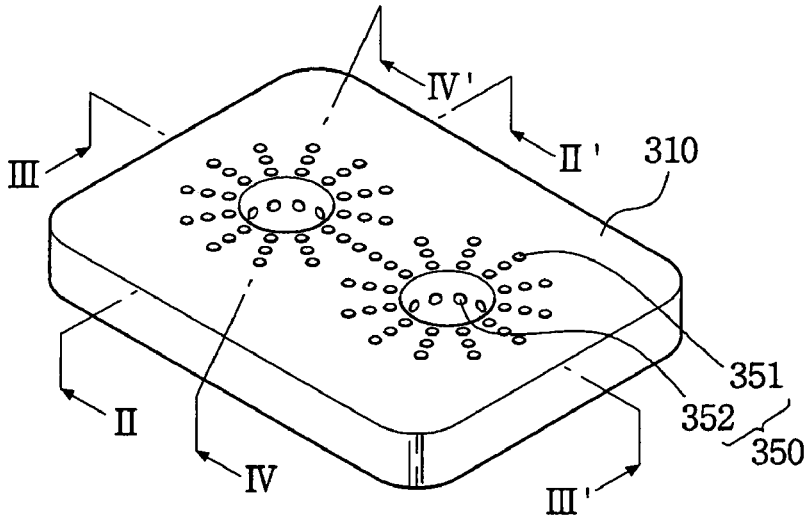
FIG. 4 is a perspective view illustrating a cleaning body according to exemplary embodiments of the invention.
Figure 5:
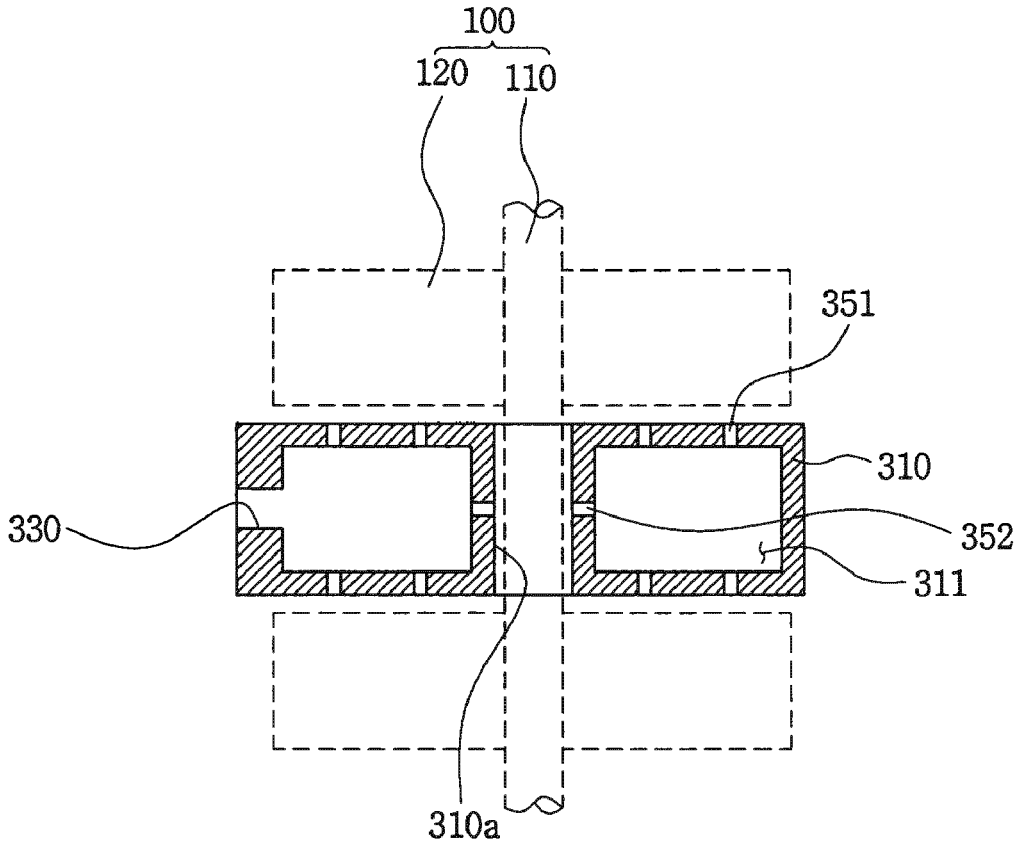
FIG. 5 is a cross-sectional view taken along line II-II' in FIG. 4.
Figure 6:
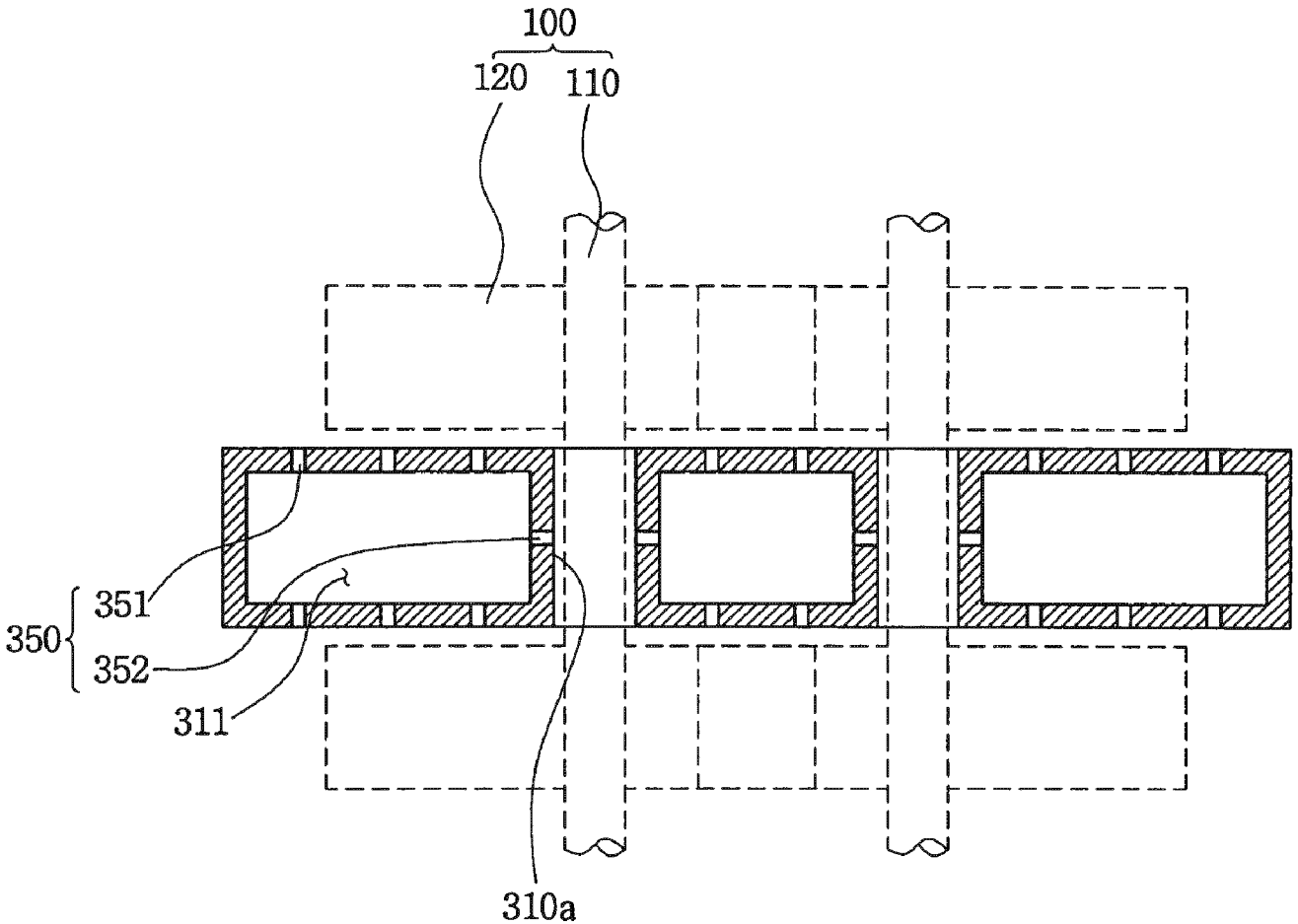
FIG. 6 is a cross-sectional view taken along line III-III' in FIG. 4.
Figure 7:
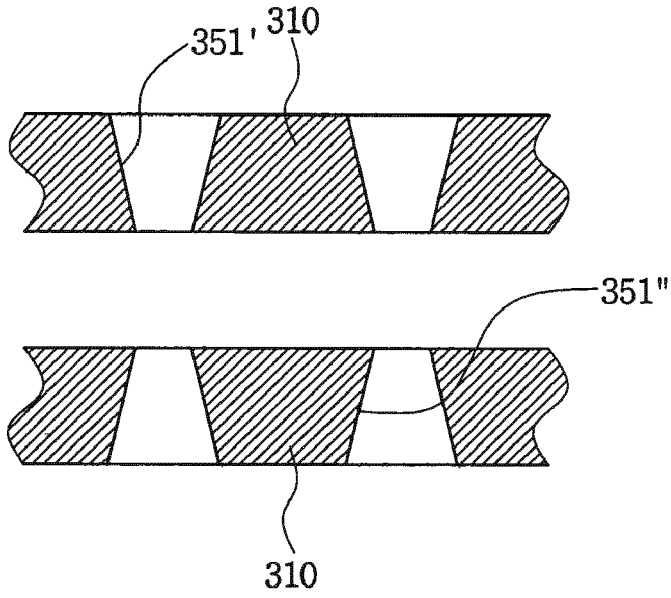
FIG. 7 is a cross-sectional view illustrating a relative diameter size of a spraying hole shown in FIG. 4.
Figure 8:
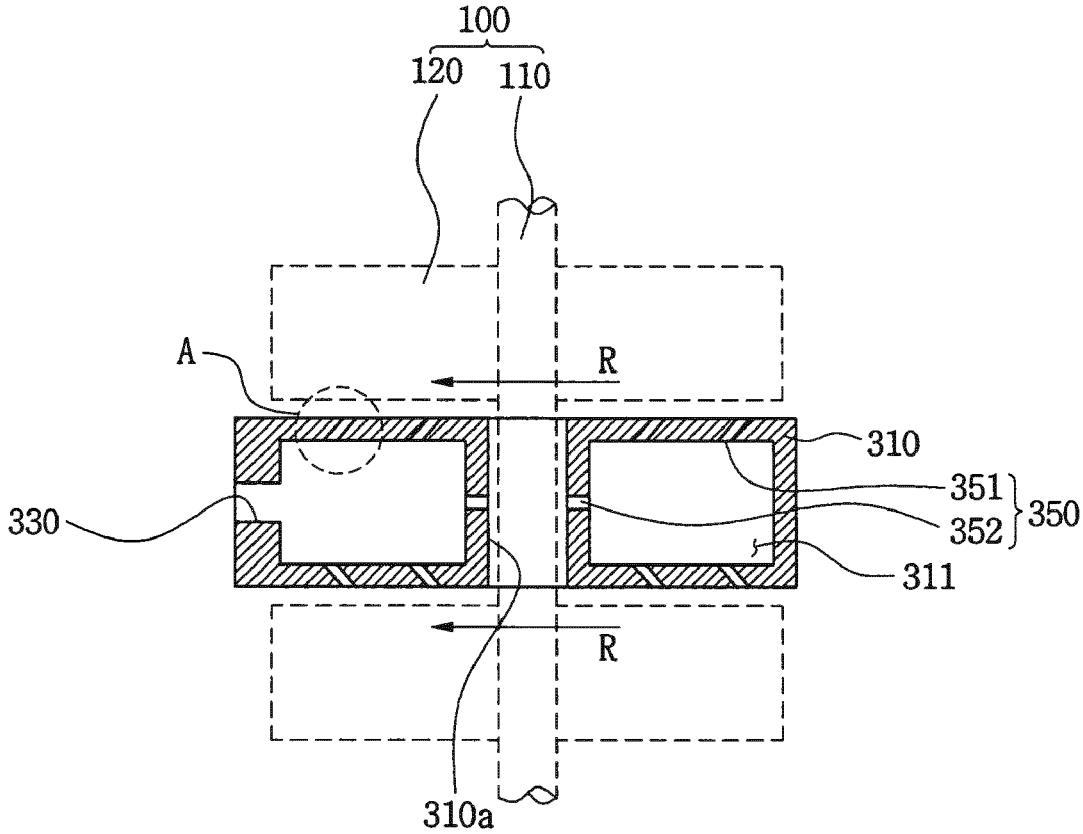
FIG. 8 is a cross-sectional view of a spraying direction of the spraying holes shown in FIG. 4.
Figure 9:
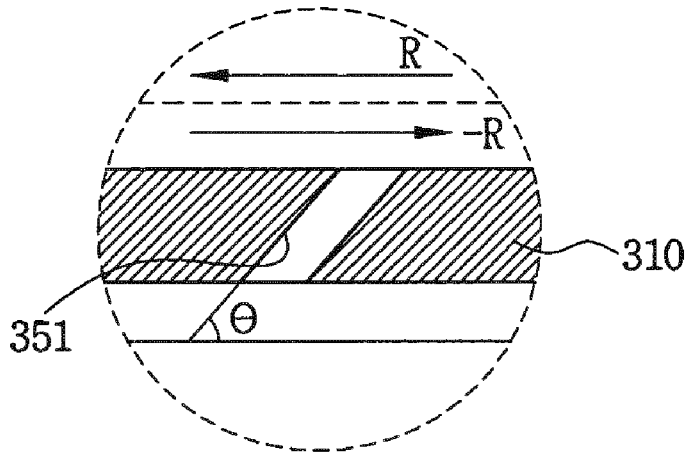
FIG. 9 is an enlarged cross-sectional view of the area "A" in FIG. 8.
Figure 10:
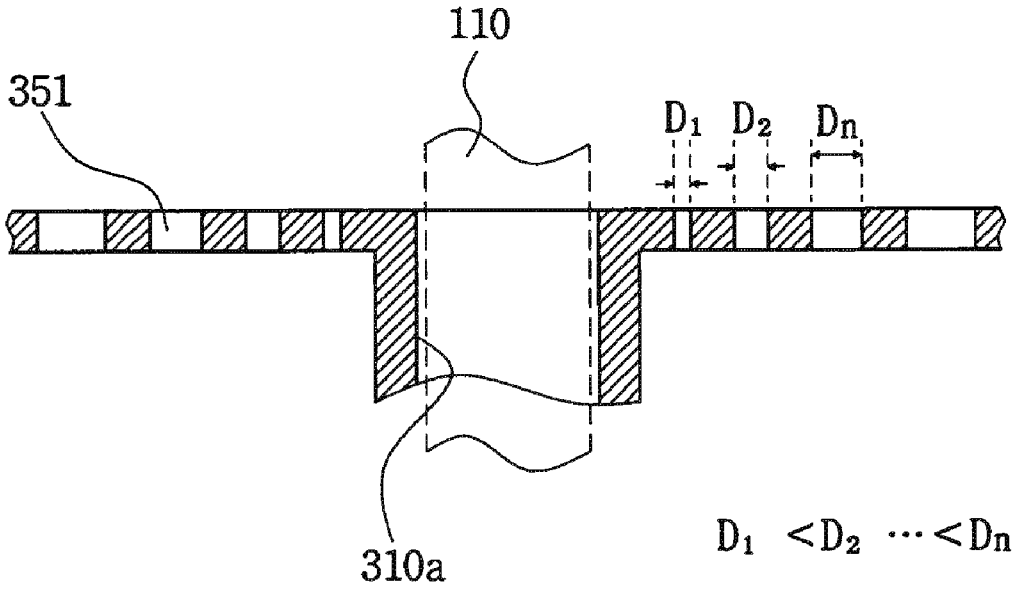
FIG. 10 is a partial cross-sectional view illustrating that the first spraying holes of FIG. 4 are different in diameter according to exemplary embodiments of the invention.
Figure 11:
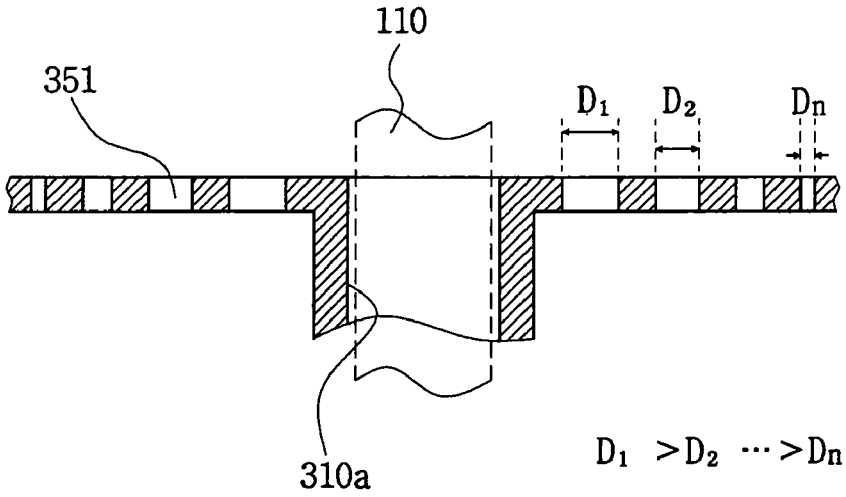
FIG. 11 is a partial cross-sectional view illustrating that the first spraying holes of FIG. 4 are different in diameter according to other exemplary embodiments of the present invention.
Figure 12:
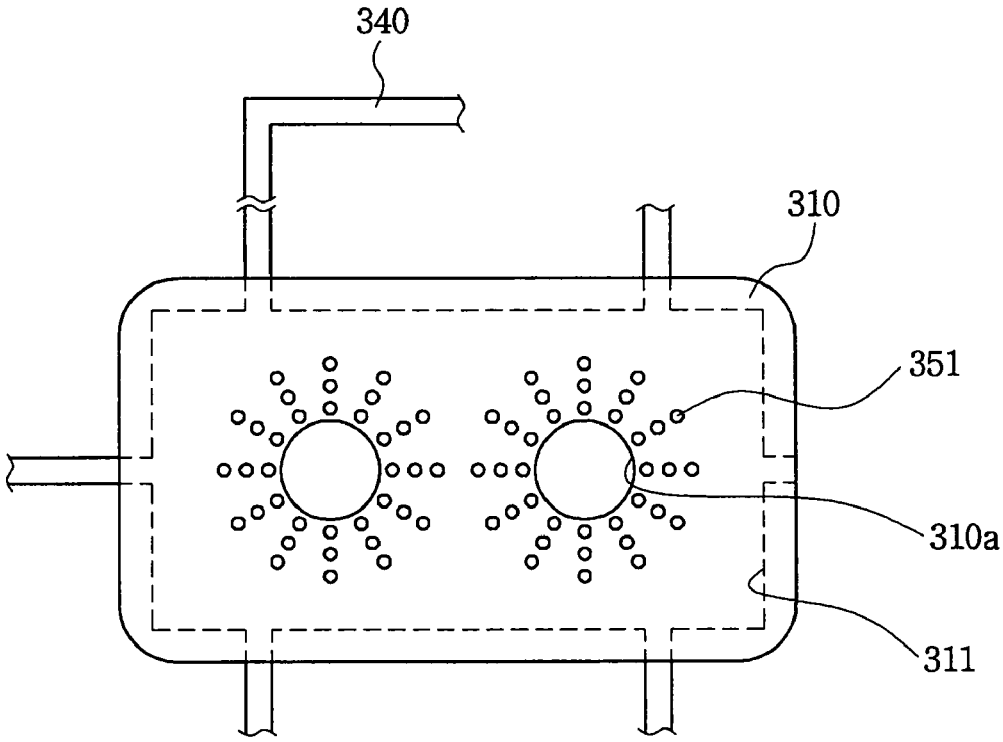
FIG. 12 is a plan view illustrating supply channels formed in the cleaning body according to exemplary embodiments of the invention.
Figure 13:
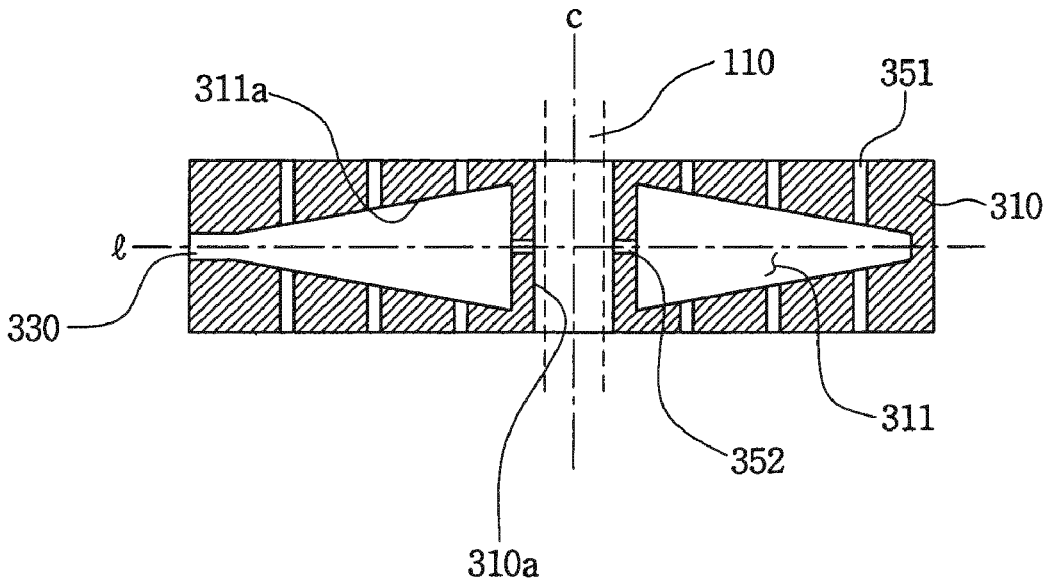
FIG. 13 is a cross-sectional view illustrating a first example of a chamber according to exemplary embodiments of the invention.
Figure 14:
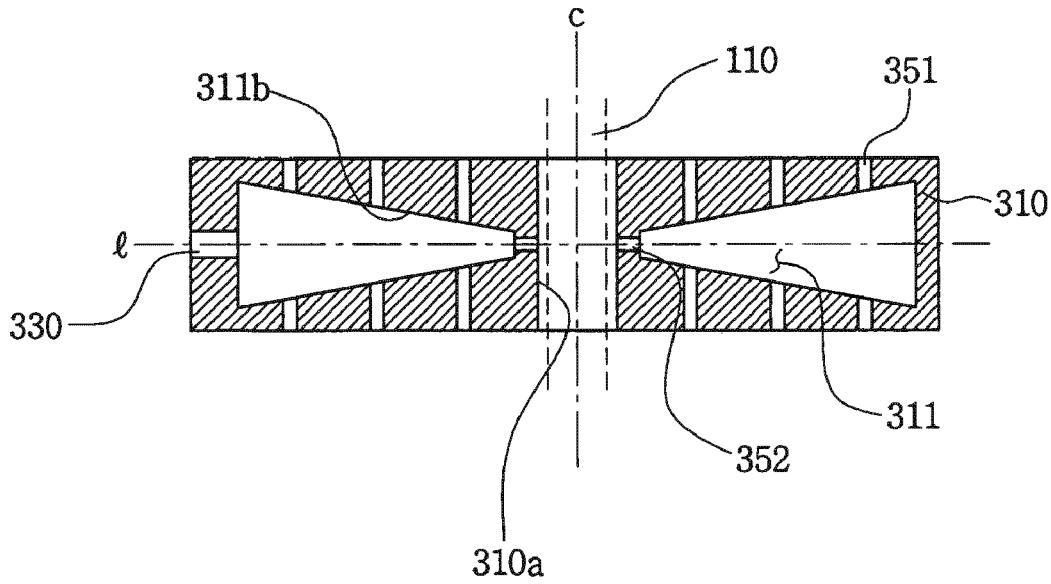
FIG. 14 is a cross-sectional view illustrating a second example of a chamber according to exemplary embodiments of the invention.
Figure 15:
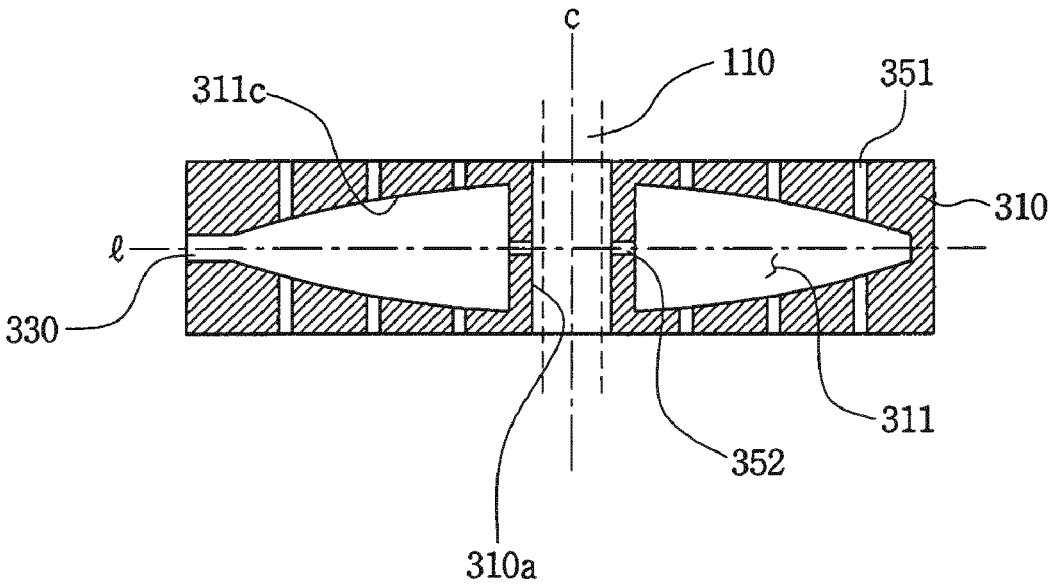
FIG. 15 is a cross-sectional view illustrating a third example of a chamber according to exemplary embodiments of the invention.
Figure 16:
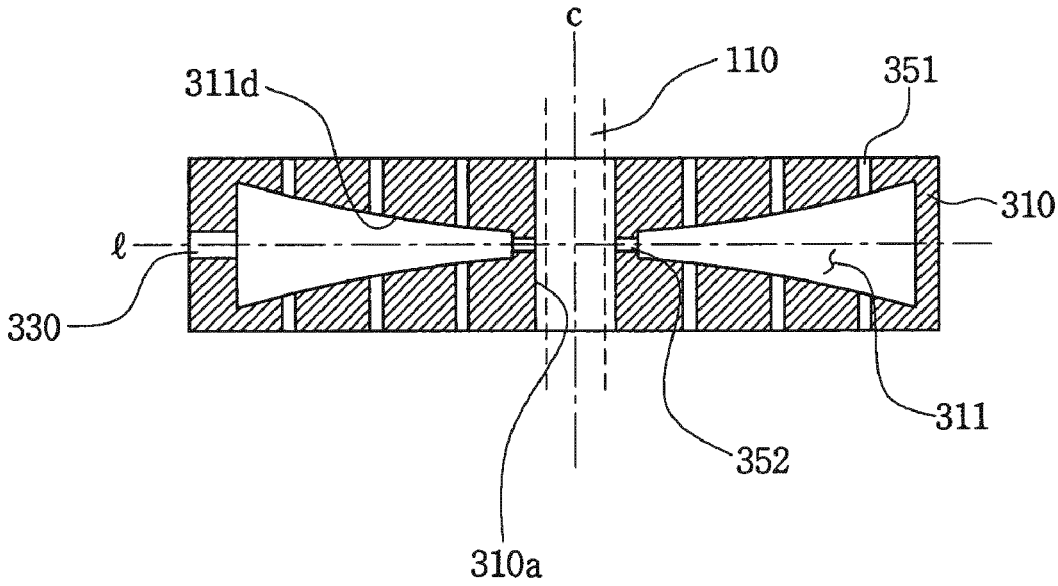
FIG. 16 is a cross-sectional view illustrating a fourth example of a chamber according to exemplary embodiments of the invention.

FIG. 2 is a perspective view of a vacuum pump having a rotation body cleaning unit according to exemplary embodiments of the invention. FIG. 3 is a cross-sectional view taken along line I-I' in FIG. 2. FIG. 4 is a perspective view illustrating a cleaning body according to exemplary embodiments of the invention. FIG. 5 is a cross-sectional view taken along line II-II' in FIG. 4. FIG. 6 is a cross-sectional view taken along line III-III' in FIG. 4. FIG. 7 is a cross-sectional view illustrating a relative diameter size of a spraying hole shown in FIG. 4. FIG. 8 is a cross-sectional view of a spraying direction of the spraying holes shown in FIG. 4. FIG. 9 is an enlarged cross-sectional view of the area "A" in FIG. 8. FIG. 10 is a partial cross-sectional view illustrating that the first spraying holes of FIG. 4 are different in diameter according to exemplary embodiments of the invention. FIG. 11 is a partial cross-sectional view illustrating that the first spraying holes of FIG. 4 are different in diameter according to other exemplary embodiments of the present invention. FIG. 12 is a plan view illustrating supply channels formed in the cleaning body according to exemplary embodiments of the invention. FIG. 13 is a cross-sectional view illustrating a first example of a chamber according to exemplary embodiments of the invention. FIG. 14 is a cross-sectional view illustrating a second example of a chamber according to exemplary embodiments of the invention. FIG. 15 is a cross-sectional view illustrating a third example of a chamber according to exemplary embodiments of the invention. FIG. 16 is a cross-sectional view illustrating a fourth example of a chamber according to exemplary embodiments of the invention.

According to exemplary embodiments of the invention, referring to FIGS. 2 and 3, a rotation body cleaning unit includes a rotation body and a cleaning part for cleaning the rotation body.

The rotation body 100 includes a rotation shaft 110 having a predetermined length, and lobes 120 protruded from the rotation shaft 110.

One end of the rotation shaft 110 is connected to a motor 200. The motor 200 applies a rotational force to the rotation shaft 110, thereby rotating the rotation shaft 110.

A cleaning part 300 is placed in a space between the lobes 120, and not only cleans particles that may be formed on exterior surfaces of both the lobes 120 and the rotation shaft 110 but also forms a slick layer on the exterior surfaces of the lobes 120 and the rotation shaft 110.

Referring to FIGS. 3 and 4, the cleaning part 300 includes: a cleaning body 310 formed with a through hole 310*a* on the center which the rotation shaft 110 penetrates and internally formed with a chamber 311; a supplier 320 supplying a cleaning material such as nitrogen gas to the chamber 311; a supply channel 330 formed in the cleaning body 310 to communicate with the chamber 311 and guiding the cleaning material to the chamber 311; a supplying tube 340 communicating the supply channel 330 with the supplier 320; and spraying holes 350 formed on the outer surface of the cleaning body 310 so as to communicate with the chamber 311. Here, the inner surface of the through holes 310*a* and the outer surface of the rotation shaft 110 may be spaced apart from each other by a predetermined distance.

As shown in FIGS. 8 and 9, the spraying holes 350 may be angled in a direction (-R) opposite to a rotational direction (R) of the rotation body 110.

The spraying holes 350 include first spraying holes 351 placed on both the top and the bottom of the cleaning body 310, and second spraying holes 352 placed on the inner surface of the through holes 310*a*. The first spraying holes 351 are arranged radially on the outer surface of the cleaning body 310, with respect to the rotation shaft 110.

As shown in FIG. 7, each spraying hole 350 may have a varied diameter. For example, the diameter of the spraying hole 350 may gradually increase or decrease outward from the chamber 311. Accordingly, it is possible to control the amount of the cleaning material sprayed from the chamber 311 through the spraying holes 350.

Referring to FIGS. 10 through 11, the first spraying holes 351 may increase or decrease in size outward from the rotation shaft 110 along the exterior surface of the cleaning body 310.

For example, the first spraying holes 351 may have different inner diameters. As shown in FIG. 10, the first spraying holes 351 may be arranged so that the diameters thereof increase outward from the rotation shaft 110 along the exterior surface of the cleaning body 310 (i.e., $D1<D2<\ldots<Dn$, where D1, D2 and Dn denote the diameters of the first spraying holes 351).

On the other hand, as shown in FIG. 11, the first spraying holes 351 may be arranged so that the diameters thereof decrease outward from the rotation shaft 110 along the exterior surface of the cleaning body 310 (i.e., $D1>D2>\ldots>Dn$, where D1, D2 and Dn denote the diameters of the first spraying holes 351).

Referring to FIG. 12, there may be several supply channels 330 so that they communicate with the chamber 311 of the cleaning body 310 at a number of positions. Thus, the supply channels 330 can guide the cleaning materials to the chamber 311 at various positions.

Meanwhile, the chamber 311 may have an inclined surface 311*a*. The inclined surface 311*a* may be formed on top and bottom walls of the chamber 311.

The inclined surface 311*a* may be formed at an angle to a normal line 1 of the rotation shaft 110.

As shown in FIG. 13, the inclined surface 311*a* may be formed to become gradually wider from the outside of the cleaning body 310 inward toward a center line c of the through hole 310*a*. On the other hand, as shown in FIG. 14, an inclined surface 3111*b* may be formed to become gradually narrower from the outside of the cleaning body 310 inward toward a center line c of the through hole 310*a*.

Also, as shown in FIG. 15, an inclined surface 311*c* may be formed to make the chamber 311 have convex top/bottom walls with respect to the normal line 1.

On the other hand, as shown in FIG. 16, an inclined surface 311*d* may be formed to make the chamber 311 have concave top/bottom walls with respect to the normal line 1.

Accordingly, the shape of the chamber 311 may vary depending on the inclined lines 311*a*, 311*b*, 311*c* and 311*d*.

With reference back to FIG. 3, the cleaning part 300 may include a controller 360 that is electrically connected to both the supplier 320 and the motor 200. The controller 360 controls the supplier 320 to operate according to a rotation speed of the rotation body 100 that is driven by the motor 200, thereby controlling the amount of the cleaning material to be supplied to the chamber 311. Here, the rotation speed of the rotation body 100 may be in proportion to the amount of the cleaning material.

With this configuration, the rotation body cleaning unit according to exemplary embodiments of the invention operates as follows.

Referring back to FIG. 3, the motor 200 applies a rotational force to the rotation shaft 110. In this example, the rotation shaft 110 rotates at a constant speed. Together with the rotation shaft 110, the lobes 120 provided in the rotation shaft 110 are rotated. At this time, the cleaning part 300 according to exemplary embodiments of the invention is placed between the lobes 120, and cleans the exterior surfaces of both the lobes 120 and the rotation shaft 110. Further, the cleaning part 300 is placed between the lobes 120 and forms a slick film to prevent byproducts such as particles from adhering to the exterior surface of the lobes 120.

The cleaning part 300 operates as follows.

The motor 200 transmits information about the rotation speed of the rotation shaft 110 to the controller 360. Then, the controller 360 sets the amount of cleaning material in proportion to the rotation speed of the rotation shaft 110, and controls the supplier 320 to supply the cleaning material to the chamber 311 on the basis of the set amount.

The cleaning material flows in the supplying tube 340 and is then guided to the supply channel 330. The cleaning material guided to the supply channel 330 is supplied to the chamber 311. Here, the cleaning material may be gas or liquid. In this embodiment, nitrogen gas is employed as the cleaning material.

When the nitrogen gas is supplied to the chamber 311, the nitrogen gas is supplied to the exterior surface of the lobes 120 via the first spraying holes 351, and to the exterior surface of the rotation shaft 110 via the second spraying holes 352. In this way, the nitrogen gas is sprayed through the first and second spraying holes 351 and 352 at a predetermined spraying pressure, so that the exterior surfaces of both the lobes 120 and the rotation shaft 110 can be cleaned. Also, the nitrogen gas forms a slick layer on the exterior surfaces of both the lobes 120 and the rotation shaft 110.

According to exemplary embodiments of the invention, referring to FIGS. 8 and 9, the first and second spraying holes 351 and 352 may be formed at an angle θ to the rotation direction and its counter direction of the rotation shaft 110. Thus, the nitrogen gas is sprayed through the first and second spraying holes 351 and 352 in a direction angled to the rotation direction R and its counter direction-R of the rotation shaft 110 and the lobes 120, thereby pushing the particles in the rotation direction R and the counter direction -R and preventing them from being formed on the exterior surfaces of the rotation shaft 110 and the lobes 120.

As shown in FIG. 4, the first spraying holes 351 may be arranged radially on the cleaning body 310, with respect to the rotation shaft 110, so that the exterior surface of the lobes 120 can be uniformly cleaned by the nitrogen gas sprayed through the first spraying holes 351.

As shown in FIG. 12, the supply channel 330 according to exemplary embodiments of the invention may be formed at a number of positions of the cleaning body 310. Accordingly, the supply channels 330 are employed for guiding the nitrogen gas, so that the nitrogen gas is uniformly supplied to the chamber 311.

As shown in FIG. 10, the first spraying holes 351 according to exemplary embodiments of the invention may be increased in size outward from the rotation shaft 110 along the exterior surface of the cleaning body 310, so that the supplied amount of nitrogen gas can be adjusted according to the positions of the exterior surface of the lobes 120. Accordingly, the amount of nitrogen gas sprayed through the first spraying holes 351 is gradually increased outward from the center of the through hole 310*a*.

As shown in FIG. 11, the first spraying holes 351 according to exemplary embodiments of the invention may be decreased in size outward from the rotation shaft 110 along the exterior surface of the cleaning body 310, so that the supplied amount of nitrogen gas can be adjusted according to the positions of the exterior surface of the lobes 120. Accordingly, the amount of nitrogen gas sprayed through the first spraying holes 351 is gradually decreased outward from the center of the lobes 120.

As shown in FIGS. 13 through 16, the chamber 311 according to exemplary embodiments of the invention may have symmetrical inclined surfaces with respect to the normal line 1 of the center line c of the rotation shaft 110. Accordingly, if the nitrogen gas supplied to the inside of the chamber 311 is sprayed through the first spraying holes 351, it is possible to control the supplied amount of the same.

In the case where the inclined surface 3111*a* is formed to become gradually wider from the outside of the cleaning body 310 toward the center line c (refer to FIG. 13), the amount of nitrogen gas supplied to the chamber may increase from the supply channel 330 toward the rotation shaft 110. Thus, the amount of nitrogen gas sprayed through the first spraying holes 351 may gradually increase from the supply channel 330 toward the rotation shaft 110.

On the other hand, in the case where the inclined surface 3111*b* is formed to become gradually narrower from the outside of the cleaning body 310 toward the center line c (refer to FIG. 14), it may be the opposite of the foregoing case.

Further, in the case where the inclined surface 311*c* is convex from the outside of the cleaning body 310 toward the center line c (refer to FIG. 15), a convex space can be supplied with more nitrogen gas than a concave space. Accordingly, more nitrogen gas may be sprayed through the first spraying holes 351 around the convex space than those around the concave space.

On the other hand, in the case where the inclined surface 311*d* is concave from the outside of the cleaning body 310 toward the center line c (refer to FIG. 16), it may be the opposite of the foregoing case.

Below, a vacuum pump having the rotation body cleaning unit according to exemplary embodiments of the invention will be described.

Referring to FIGS. 2 and 3, a vacuum pump according to exemplary embodiments of the invention includes a case 190, a pair of rotation bodies 100, and a cleaning part 300 for cleaning the rotation bodies 100.

A rotation body 100 includes a pair of rotation shafts 110. Each rotation shaft 110 includes a number of lobes 120 at regular intervals along the lengthwise direction thereof. The lobes 120 provided in the respective rotation shafts 110 are in contact with each other, so that the lobes 120 interlock each other when one of the pair of rotation shafts 110 rotates. One of the pair of rotation shafts 110 is connected to a motor 200. The motor 200 is connected to one end part of the rotation shaft 110 and applies the rotational force to the rotation shaft 110.

Opposite ends of each rotation shaft 110 are rotatably supported by rotation guide holes 192 formed at opposite ends of a case 190, respectively. Further, the case 190 is provided with an inlet (not shown) and an outlet (not shown) which communicate with the inside of the case 190.

The cleaning part 300 includes: a cleaning body 310 having a pair of through holes 310*a* through which the pair of rotation shafts 110 passes, and forming a chamber 311 therein; a supplier 320 for supplying a cleaning material such as nitrogen gas to the chamber 311; a supply channel 330 formed in the cleaning body 310, communicating with the chamber 320, and guiding the cleaning material to the inside of the chamber 311; a supplying tube 340 communicating the supply channel 330 with the supplier 320; and spraying holes 350 formed on an exterior surface of the cleaning body 310. Here, an inner surface of the through hole 310*a* may be spaced apart from an exterior surface of the rotation shaft 110 by a predetermined distance.

The cleaning bodies 310 are placed between the lobes 120. The exterior surfaces of the cleaning bodies 310 may be spaced apart from the exterior surfaces of the lobes 120 by a predetermined distance.

The cleaning bodies 310 may be supported while they are inserted in a supporting hole 191 of the case 190.

As shown in FIGS. 8 and 9, the spraying holes 350 may be formed at an angle θ to the rotation direction R and its counter direction -R of the rotation shaft 110.

The spraying holes 350 include first spraying holes 351 formed on top and bottom surfaces of the cleaning body 310, and second spraying holes 352 formed on the inner surface of the through holes 310*a*. The first spraying holes 351 are arranged radially on the outer surface of the cleaning body 310 with respect to the rotation shaft 110.

As shown in FIG. 7, each spraying hole 350 may have a varied diameter. For example, the diameter of the spraying hole 350 may gradually increase or decrease outward from the chamber 311. Accordingly, it is possible to control the amount of the cleaning material sprayed from the chamber 311 through the spraying holes 350.

Referring to FIGS. 10 and 11, the first spraying holes 351 may increase or decrease in size outward from the rotation shaft 110 along the exterior surface of the cleaning body 310.

For example, the first spraying holes 351 may have different inner diameters. As shown in FIG. 10, the first spraying holes 351 may be arranged so that the diameters thereof increase outward from the rotation shaft 110 along the exterior surface of the cleaning body 310 (i.e., $D1<D2<\ldots<Dn$, where D1, D2 and Dn denote the diameters of the first spraying holes 351).

On the other hand, as shown in FIG. 11, the first spraying holes 351 may be arranged so that the diameters thereof decrease outward from the rotation shaft 110 along the exterior surface of the cleaning body 310 (i.e., D1>D2> . . . >Dn, where D1, D2 and Dn denote the diameters of the first spraying holes 351).

Referring to FIG. 12, there may be several supply channels 330 so that they communicate with the chamber 311 of the cleaning body 310 at a number of positions. Thus, the supply channels 330 can guide the cleaning materials to the chamber 311 at various positions.

Meanwhile, the chamber 311 may have an inclined surface 311*a*. The inclined surface 311*a* may be formed on top and bottom walls of the chamber 311.

The inclined surface 311*a* may be formed at an angle to a normal line 1 of the rotation shaft 110.

As shown in FIG. 13, the inclined surface 3111*a* may be formed to become gradually wider from the outside of the cleaning body 310 inward toward a center line c of the through hole 310*a*. On the other hand, as shown in FIG. 14, an inclined surface 311*b* may be formed to become gradually narrower from the outside of the cleaning body 310 inward toward a center line c of the through hole 310*a*.

Also, as shown in FIG. 15, an inclined surface 311*c* may be formed to make the chamber 311 have convex top/bottom walls with respect to the normal line 1.

On the other hand, as shown in FIG. 16, an inclined surface 311*d* may be formed to make the chamber 311 have concave top/bottom walls with respect to the normal line 1.

Accordingly, the shape of the chamber 311 may vary depending on the inclined lines 311*a*, 311*b*, 311*c* and 311*d*.

With reference back to FIG. 3, the cleaning part 300 may include a controller 360 that is electrically connected to both the supplier 320 and the motor 200. The controller 360 controls the supplier 320 to operate according to a rotation speed of the rotation body 100 that is driven by the motor 200, thereby controlling the amount of the cleaning material to be supplied to the chamber 311. Here, the rotation speed of the rotation body 100 may be in proportion to the amount of the cleaning material.

With this configuration, the vacuum pump having the rotation body cleaning unit according to exemplary embodiments of the invention operates as follows.

Referring back to FIGS. 2 and 3, the motor applies a rotation force to the rotation shaft 110. The rotation shaft 110 rotates at a speed depending on the rotation force. The lobe 120 of the rotation shaft 110, which is rotating, rotates the interlocked lobe 120 being contacting therewith. Therefore, the corresponding rotation shaft 110 provided with the interlocked lobe 120 rotates.

In this state, fluid flows in the case 190 through the inlet, and then flows out through the outlet. Accordingly, a process chamber (not shown) communicating with the inlet may be vacuumized, which is not illustrated. Here, the fluid may contain a gas introduced from the process chamber after a process.

Inside the process chamber, byproducts are produced during a semiconductor manufacturing process or thereafter. The byproducts are introduced into the case 190 and then exhausted through the outlet. However, such byproducts may be adhered to the exterior surfaces of both the rotation shaft 119 and the lobes 120.

According to exemplary embodiments of the invention, the cleaning part 300 is disposed in a space between the lobes 120 and cleans the byproducts adhered to the exterior surfaces of both the lobes 120 and the rotation shaft 110. Further, the cleaning part 300 forms a slick film layer on the exterior surfaces of both the lobes 120 and the rotation shaft 110, thereby preventing the byproducts from being adhered to the exterior surfaces.

The operations of the cleaning part 300 will be described in more detail.

The motor 200 transmits information about the rotation speed of the rotation shaft 110 to the controller 360. Then, the controller 360 sets the amount of cleaning material in proportion to the rotation speed of the rotation shaft 110, and controls the supplier 320 to supply the cleaning material to the chamber 311 on the basis of the set amount.

The cleaning material flows in the supplying tube 340 and is then guided to the supply channel 330. The cleaning material guided to the supply channel 330 is supplied to the chamber 311. Here, the cleaning material may be gas or liquid. In this embodiment, nitrogen gas is employed as the cleaning material, but any appropriate cleaning material may be used.

When the cleaning material is supplied to the chamber 311, the cleaning material is supplied to the exterior surface of the lobes 120 via the first spraying holes 351, and to the exterior surface of the rotation shaft 110 via the second spraying holes 352. In this way, the cleaning material is sprayed through the first and second spraying holes 351 and 352 at a predetermined spraying pressure, so that the exterior surfaces of both the lobes 120 and the rotation shaft 110 can be cleaned.

Referring to FIGS. 8 and 9, the first and second spraying holes 351 and 352 according to exemplary embodiments of the invention may be formed at an angle θ to the rotation direction and its counter direction of the rotation shaft 110. Thus, the cleaning material is sprayed through the first and second spraying holes 351 and 352 in a direction angled to the rotation direction R and its counter direction -R of the rotation shaft 110 and the lobes 120, thereby pushing the particles in the rotation direction R and the counter direction -R and preventing them from being formed on the exterior surfaces of the rotation shaft 110 and the lobes 120.

As shown in FIG. 4, the first spraying holes 351 are arranged radially on the cleaning body 310, with respect to the rotation shaft 110, so that the exterior surface of the lobes 120 can be uniformly cleaned by the cleaning material sprayed through the first spraying holes 351.

As shown in FIG. 12, the supply channel 330 according to exemplary embodiments of the invention may be formed at a number of positions of the cleaning body 310. Accordingly, the supply channels 330 are employed for guiding the cleaning material, such as nitrogen gas, so that the cleaning material is uniformly supplied to the chamber 311.

As shown in FIG. 10, the first spraying holes 351 according to exemplary embodiments of the invention are varied in size outward from the rotation shaft 110 along the exterior surface of the cleaning body 310, so that the supplied amount of cleaning material can be adjusted according to the positions of the exterior surface of the lobes 120. In the embodiment illustrated in FIG. 10, the hole size of the first spraying holes 351 increases with the distance away from the rotation shaft 110. Accordingly, the amount of cleaning material sprayed through the first spraying holes 351 is gradually increased outward from the center of the through hole 310*a*.

As shown in FIG. 11, the size of the first spraying holes 351 according to other exemplary embodiments of the invention decrease in size outward from the rotation shaft 110 along the exterior surface of the cleaning body 310, so that the supplied amount of cleaning material, such as nitrogen gas, can be adjusted according to the positions of the exterior surface of the lobes 120. Accordingly, the amount of cleaning material sprayed through the first spraying holes 351 is gradually decreased outward from the center of the lobes 120.

As described above, the spraying holes 350 have different sizes so that the spraying amount of the cleaning material can be selectively different between the exterior surface of the lobe 120 and the exterior surface of the rotation shaft 110. For example, with regard to the above, if more byproducts are adhered to the center region of the exterior surface of the lobe 120 than a neighboring region around the center region, the spraying holes 350 corresponding to the center region may be enlarged so that more cleaning material can be supplied to the center region.

As shown in FIGS. 13 through 16, the chamber 311 according to exemplary embodiments of the invention may have symmetrical inclined surfaces with respect to the normal line 1 perpendicular to the center line c of the rotation shaft 110. Accordingly, if the cleaning material supplied to the inside of the chamber 311 is sprayed through the first spraying holes 351, it is possible to control the supplied amount of the same.

In a case where the inclined surface 311*a* is formed to become gradually wider from the outside of the cleaning body 310 toward the center line c, the amount of cleaning material supplied to the chamber may increase from the supply channel 330 toward the rotation shaft 110. Thus, the amount of cleaning material sprayed through the first spraying holes 351 may gradually increase from the supply channel 330 toward the rotation shaft 110.

On the other hand, as shown in FIG. 14, in the case where the inclined surface 311*b* is formed to become gradually narrower from the outside of the cleaning body 310 toward the center line c, it may be the opposite of the foregoing case.

Referring to FIG. 15, in the case where the inclined surface 311*c* is convex from the outside of the cleaning body 310 toward the center line c, a convex space can be supplied with more cleaning material than a concave space. Accordingly, more cleaning material may be sprayed through the first spraying holes 351 around the convex space than those around the concave space.

On the other hand, as shown in FIG. 16, in the case where the inclined surface 311*d* is concave from the outside of the cleaning body 310 toward the center line c, it may be the opposite of the foregoing case.

Accordingly, the shape of the chamber 311 according to exemplary embodiments of the invention may vary depending on the inclined surfaces 311*a*, 311*b*, 311*c* and 311*d* formed therein, and thus the space of the chamber 311 may vary. The larger the space of the chamber 311 is, the more cleaning material is introduced from the supply channel 330. Thus, more cleaning material is sprayed through the spraying holes 350 corresponding to the large space than those corresponding to the small space, so that the cleaning material sprayed through the spraying holes 350 corresponding to the large space can not only easily clean the exterior surfaces of both the lobe 120 and the rotation shaft 110, but also form the slick film on the exterior surfaces of both the lobe 120 and the rotation shaft 110, thereby preventing the byproducts from adhering to the exterior surfaces of both the lobe 120 and the rotation shaft 110.

As described above, embodiments of the present invention include a rotation body cleaning unit and a vacuum pump having the same.

According to exemplary embodiments of the invention, a cleaning part is placed between lobes provided in the rotation body, and sprays a cleaning material such as nitrogen gas toward the exterior surface of the lobe and the exterior surface of a rotation shaft, thereby cleaning the exterior surfaces of both the lobe and the rotation shaft and preventing byproducts from adhering thereto.

According to exemplary embodiments of the invention, the spraying holes are arranged radially on a cleaning body while facing the lobes, so that the cleaning material can be uniformly sprayed to the exterior surface of the lobes through the spraying holes.

According to exemplary embodiments of the invention, the cleaning material is sprayed at an angle in a direction opposite to a rotational direction of the rotation body, thereby enhancing efficiency of cleaning the exterior surface of both the lobe and the rotation shaft.

According to exemplary embodiments of the invention, the cleaning material is sprayed on the exterior surfaces of the lobes at various spraying pressures by changing the size of the spraying holes formed on the cleaning body and by changing the shape of the chamber formed inside the cleaning body. Accordingly, it is possible to control the cleaning efficiency to be applied differently to the exterior surface of the lobe.

According to exemplary embodiments of the invention, the amount of the cleaning material sprayed through the spraying holes of the cleaning body may vary depending on rotation speed of the rotation body.

Exemplary embodiments of the present invention have been disclosed herein and, although specific terms are employed, they are used and are to be interpreted in a generic and descriptive sense only and not for purposes of limitation. Accordingly, it will be understood by those of ordinary skill in the art that various changes in form and details may be made without departing from the spirit and scope of the present invention as set forth in the following claims.

What is claimed is:

1. A rotation body cleaning unit comprising a rotation body including a rotation shaft having lobes, and a cleaning part arranged in the vicinity of the lobes and structured to clean the rotation body, wherein the cleaning part comprises:

a cleaning body having a chamber defined therein;

spraying holes for communicating the chamber with the outside and formed on an outer surface of the cleaning body to be oriented toward the rotation body;

a supply channel formed in the cleaning body to communicate the chamber with the outside; and a supplier in communication with the supply channel to supply a cleaning material into the chamber, wherein the cleaning body is arranged to surround the rotation shaft.

2. The rotation body according to claim 1, wherein the chamber has angled surfaces symmetrical with respect to a normal line perpendicular to the rotation shaft.

3. The rotation body according to claim 1, wherein the spraying holes comprise:

first spraying holes facing the lobes; and second spraying holes facing the rotation shaft, wherein the first spraying holes are arranged radially with respect to the rotation shaft and varied in size from the rotation shaft.

4. The rotation body according to claim 1, wherein the spraying holes are formed in a direction angled to a rotation direction and its counter direction of the rotation body.

5. The rotation body according to claim 1, wherein the supply channel is formed in the cleaning body at a plurality of positions, and guides the cleaning material to the chamber.

6. The rotation body according to claim 1, wherein the spraying holes have different inner diameters.

7. The rotation body according to claim 1, wherein the rotation body is rotated by a motor connected to the rotation shaft, the cleaning part includes a controller electrically connected to both the supplier and the motor, and the controller controls the supplier related to a rotation speed of the rotation body rotated by the motor and controls the amount of the cleaning material supplied to the chamber.

8. A vacuum pump comprising:

a case including rotation guide holes at opposite ends;

a rotation body disposed inside the case, and including a rotation shaft having opposite ends rotatably supported by the rotation guide holes and a plurality of lobes in the rotation shaft at predetermined intervals; and a cleaning part supported by the case and disposed in a space between the lobes to clean the rotation body, wherein the cleaning part comprises a cleaning body having a chamber defined therein, spraying holes for communicating the chamber with the outside and formed on an outer surface of the cleaning body oriented toward the rotation body, a supply channel formed in the cleaning body to communicate the chamber with the outside, and a supplier in communication with the supply channel to supply a cleaning material into the chamber, and wherein the cleaning body is arranged to surround the rotation shaft.

9. The vacuum pump according to claim 8, wherein the chamber has inclined surfaces symmetrical with respect to a normal line of the rotation shaft.

10. The vacuum pump according to claim 8, wherein the spraying holes comprise: first spraying holes facing the lobes;

and second spraying holes facing the rotation shaft, wherein the first spraying holes are arranged radially with respect to the rotation shaft and are varied in size gradually from the rotation shaft.

11. The vacuum pump according to claim 8, wherein the spraying holes are formed in a direction angled to a rotation direction and its counter direction of the rotation body.

12. The vacuum pump according to claim 8, wherein the supply channel is formed in the cleaning body at a plurality of positions, and guides the cleaning material to the chamber.

13. The vacuum pump according to claim 8, wherein the spraying holes have different inner diameters.

14. The vacuum pump according to claim 8, wherein the rotation body is structured to be rotated by a motor connected to the rotation shaft, the cleaning part includes a controller electrically connected to both the supplier and the motor, and the controller controls the supplier related to a rotation speed of the rotation body rotated by the motor, and controls the amount of the cleaning material supplied to the chamber.

15. The vacuum pump according to claim 8, wherein the case comprises an inlet and an outlet which communicate with the inside thereof.

* * * * *